United States Patent [19]

Ando

[11] Patent Number: 4,471,746

[45] Date of Patent: Sep. 18, 1984

[54] BALL THROWING APPARATUS

[75] Inventor: Hideki Ando, Gifu, Japan

[73] Assignee: Shimon Ando, Hitachi, Japan

[21] Appl. No.: 130,442

[22] Filed: Mar. 14, 1980

[51] Int. Cl.[3] ..... F41B 3/04

[52] U.S. Cl. ..... 124/6; 124/41 R; 124/80

[58] Field of Search ..... 124/6, 41 R, 79, 1, 124/4, 7, 54

[56] References Cited

U.S. PATENT DOCUMENTS

| | | | |
|---|---|---|---|
| 1,146,262 | 7/1915 | Judd | 124/7 |
| 1,190,565 | 7/1916 | Long | 124/6 |
| 1,198,300 | 9/1916 | Watkins | 124/41 R UX |
| 3,556,071 | 1/1971 | Udesen | 124/50 X |
| 4,365,612 | 12/1982 | Defosse | 124/54 |

FOREIGN PATENT DOCUMENTS

| | | | |
|---|---|---|---|
| 70530 | 11/1915 | Fed. Rep. of Germany | 124/6 |

*Primary Examiner*—Richard J. Apley
*Assistant Examiner*—William R. Browne
*Attorney, Agent, or Firm*—Wenderoth, Lind & Ponack

[57] ABSTRACT

A ball throwing apparatus for practicing baseball, tennis and the like and including a rotating body with a ball receiving port on one side and a ball projecting port on the other side, and a ball holder and a held ball releasing provided at the ball projecting port; the ball put through the ball receiving port is accelerated in the direction of rotation of the rotary body, and the ball is projected out from the ball projecting port at a predetermined speed and in an exact predetermined direction by releasing the centrifugal force instantaneously at a previously set angle or projecting the ball out from the ball projecting port in the tangential direction of the circle of rotation of the ball.

3 Claims, 18 Drawing Figures

BALL THROWING APPARATUS

BACKGROUND OF THE INVENTION

The invention relates to a ball throwing apparatus which is able to accurately throw a ball or balls for baseball, softball, tennis, Ping-Pong and the like at the predetermined speed, and at a predetermined angle to any selected direction.

The machine for throwing balls for baseball is well known as a pitching machine. Such a machine can be classified into three kinds.

(1) A machine which throws a ball from a cylinder by compressed air or by the action of a compression spring. In this machine, the ball can be thrown out with an accurate control. However, it is difficult to give rotation, i.e.—spin, to the ball for curving it in the desired direction. Also, a large compression force is required to give the ball a high speed. Accordingly, since the machine has a defect in that it is large in size, it is presently not used very much.

(2) A machine which throws the ball by means of friction, that is the ball is introduced between two tires which are rotated mutually in opposite directions by a motor. The machine is of a simple construction, and used widely since it has advantages in that the direction of curve of the ball can be varied by changing the extent of rotation of both tires, the speed of the ball can be varied by varying the mean rotation speed of these tires, and the spin speed i.e.—the rotation of the ball, can be varied by means of the difference between rotation speeds of the two tires. However, it has the following defects; (a) as the ball is deformed between the two tires, a large force has to be applied to the ball at the instant the ball passes through the contact point of these tires; (b) the ball is heavily worn due to the large instantaneous friction force which acts on it; (c) as the wear of the ball reduces the roughness of the surface of the ball, the speed of the ball is lowered; and (d) since the direction of travel of the ball is delicately affected by the adhesive power of the tires with respect to the ball at the moment it leaves the tires, the ball is difficult to control. In the case of tennis ball whose surface is napped, it is easily worn away. The machine is also difficult to use for pitching a baseball for batting practice in which the ball must be thrown a long distance at a high speed.

(3) Ball throwing machine utilizing energy stored by a cam and spring. The mechanism of this is as follows. An arm is driven by an electric motor. Through a cam on a rotation axis, the energy is stored by a spring. After the cam passes through the lower dead point, the stored energy is transmitted for rotating the arm. The ball to be thrown is received in a bowl-like ball receptacle in a nearly static state and then the arm is swung. The ball is thrown out from the bowl by the centrifugal force and made to travel in the tangential direction of the circle of rotation at the time point of being thrown away. Thus, the mechanism of the machine is so simple that the machine is widely used.

However, it has some defects which will be described in the following: (a) The ball leaves the arm when the ball rolls out of the ball receptacle due to the centrifugal force caused by the rotation of the arm, the angle of rotation of the arm at this instant is delicately affected by the angular acceleration of the rotation of the arm, i.e. the strength of the spring, the frictional force of the ball receptacle and the like. Therefore, the ball is apt to be controlled inaccurately; (b) since the ball can not be spun, it can not be curved; (c) the speed of the ball restricted by the size of the compression spring. Therefore the ball can not be thrown at a high speed; (d) After the ball is thrown out, a large oscillation may occur on the machine. Accordingly, it must be firmly fixed on the ground, and therefore it can not be arbitrarily moved around when used outdoors.

The three kinds of apparatus described above utilize an electric motor, requiring an electric power source. These apparatus can therefore not easily be used out of doors where such a power source is not normally available.

In the future, it will be necessary to train baseball, tennis or Ping-Pong players through the use of automatic ball throwing apparatus with a control device including a computer operating in accordance with a stored program.

However, according to any one of these prior art apparatus, it is difficult to automate the direction and the speed of the thrown ball as well as the direction and the extent of the curve of ball.

SUMMARY OF THE INVENTION

The applicant of the present invention has improved the ball throwing apparatus so as to remove the defects in the prior art as described above. The applicant of the present invention has invented a ball throwing apparatus wherein in a state of rotation of a ball in the predetermined direction and speed, the ball is also rotated at a predetermined speed and direction in a predetermined plane. At the predetermined angle of rotation, the centrifugal force for the ball is released instantaneously, the ball being thrown out in the tangential direction of the locus of the circular motion during rotation at that moment, and the ball can be thrown in the predetermined direction and speed thereby being curved in the predetermined direction and extent.

The present invention basically comprises: a rotary member with one end as the center of rotation and the other end as a port for throwing a body and a passage from said one end to said other end; a supporting member which rotatably freely supports said rotary member on its own axis provided on the supporting member a rotary driving means for driving said rotary member at a high rotational speed; a body holding means provided at the body throwing port of said rotary member, and a releasing means for releasing the holding of the body engaging with said body supporting means at any angle of rotation of the rotatry member which is rotating; wherein a ball like body introduced into the body projecting port through the passage of the rotating rotary member is projected out in the tangential direction of the circle of rotation by being released from the centrifugal force acting on the body in the state in which the ball-like body is held by the body holding means.

According to the present invention, when a hollow rod is rotated with any one point of it as the center, and a ball is supplied to the central portion of its axis of rotation, the ball is pushed against the edge of the rotary member by the centrifugal force. If a holding member for holding the ball is provided at the edge of the rotary member, the ball will be in a circular motion with the center of rotation of the rotary member as the center, while the ball being held by the holding member. Furthermore, if the ball is rotated by the holding member, it revolves with the center of rotation of the rotary member as the center while it is rotating. In this state, if the portion which is holding the ball in the holding member is removed suddenly or the centrifugal force acting on the ball is released by projecting the ball, the ball can be thrown out in the tangential direction of the circular locus at the time of rotation and, at the instant of being released, the direction of curving of the ball and the extent of the curving are exactly regulated by the direction of rotation of the ball which travels in the rotary member, the speed of rotation and the travelling speed of the ball being accurately governed by the rotational speed of the rotary member.

Such a rotation can be caused not as an instantaneous motion but as a steady one. Therefore, the direction and the extent of the curve, and the travelling speed of the ball can be controlled exactly. Furthermore, the direction of travel of the ball can be regulated by the direction of the plane of rotation of the rotary body, and the angle of elevation at the time when the ball leaves the rotary body can be controlled by the angle of rotation of the rotary body at the time of projecting the ball from the holding member in the rotary body.

The present invention provides a ball throwing apparatus which can exactly control the direction and speed of travel, and the direction and extent of curve of the ball by mechanically and accurately regulating the direction of the plane of rotation and the angle of rotation of the rotary body at the time of projecting the ball.

BRIEF DESCRIPTION OF THE DRAWINGS

FIG. 2 is an oblique view showing the whole external appearance of the apparatus.

FIG. 3 is an oblique view taken from the opposite direction to that in FIG. 2.

FIG. 4 is a sectional view showing the mechanism of the ball throwing apparatus show in FIG. 3.

FIG. 5 is a partial front view showing a geometrical relation among a hook lever, a projecting lever and a ball when the ball held at the top of a rotary rod which is rotating is projected by the projecting lever.

FIG. 6 is an oblique view showing a hook lever driving member which is provided in an operating lever.

FIG. 7 is an oblique view showing the external appearance of an embodiment of the manual ball throwing apparatus and the state in which it is used.

FIG. 8 is a diagram showing the action of the apparatus shown in FIG. 7.

FIG. 9 is an oblique view showing another embodiment of the manual ball throwing apparatus according to the present invention and the state in which it is used.

FIG. 10 is a front view of the apparatus shown in FIG. 9.

FIG. 11 is a partial sectional view showing the hook lever driving mechanism driven by its solenoid.

FIG. 12 is an oblique view showing a fundamental ball throwing system of the electrically driven ball throwing apparatus of the present invention.

FIG. 13 is an oblique view showing the ball throwing apparatus with a ball projecting mechanism of the solenoid at the top of the rotary rod.

FIG. 14 is a partial sectional front view showing the ball projecting mechanism in FIG. 13.

FIG. 15 is an explanative oblique view showing the state in which the rotation is given to the ball held at the top of the rotary rod that is the revolution of the ball is caused.

FIG. 16 is a diagram showing the arrangement of a spin controlling plate for rotating the ball held at the top of the rotary rod and a spinning wheel.

FIG. 17 is an oblique view showing a mount, as well as a motor, a detector and a driving mechanism in the case of the automatic control of an operating handle by a servo mechanism of an electric motor.

FIG. 18 is a block diagram of a system for controlling the ball throwing apparatus of the present invention with a control device such as a computer.

DETAILED DESCRIPTION OF THE INVENTION

Figure 1:
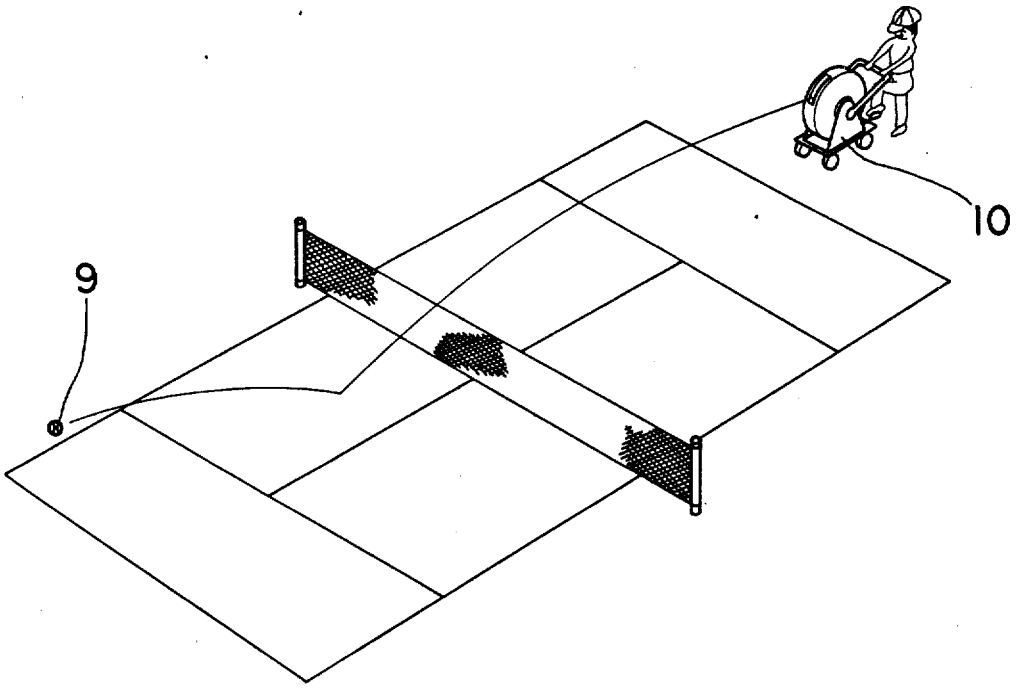
FIG. 1 is a diagram showing the ball throwing apparatus according to the present invention being used for practicing tennis.

Although the ball throwing apparatus of the present invention can be used for pitching in batting practice, there is shown the state of throwing a tennis ball by the apparatus of the present invention in FIG. 1.

Figure 2:
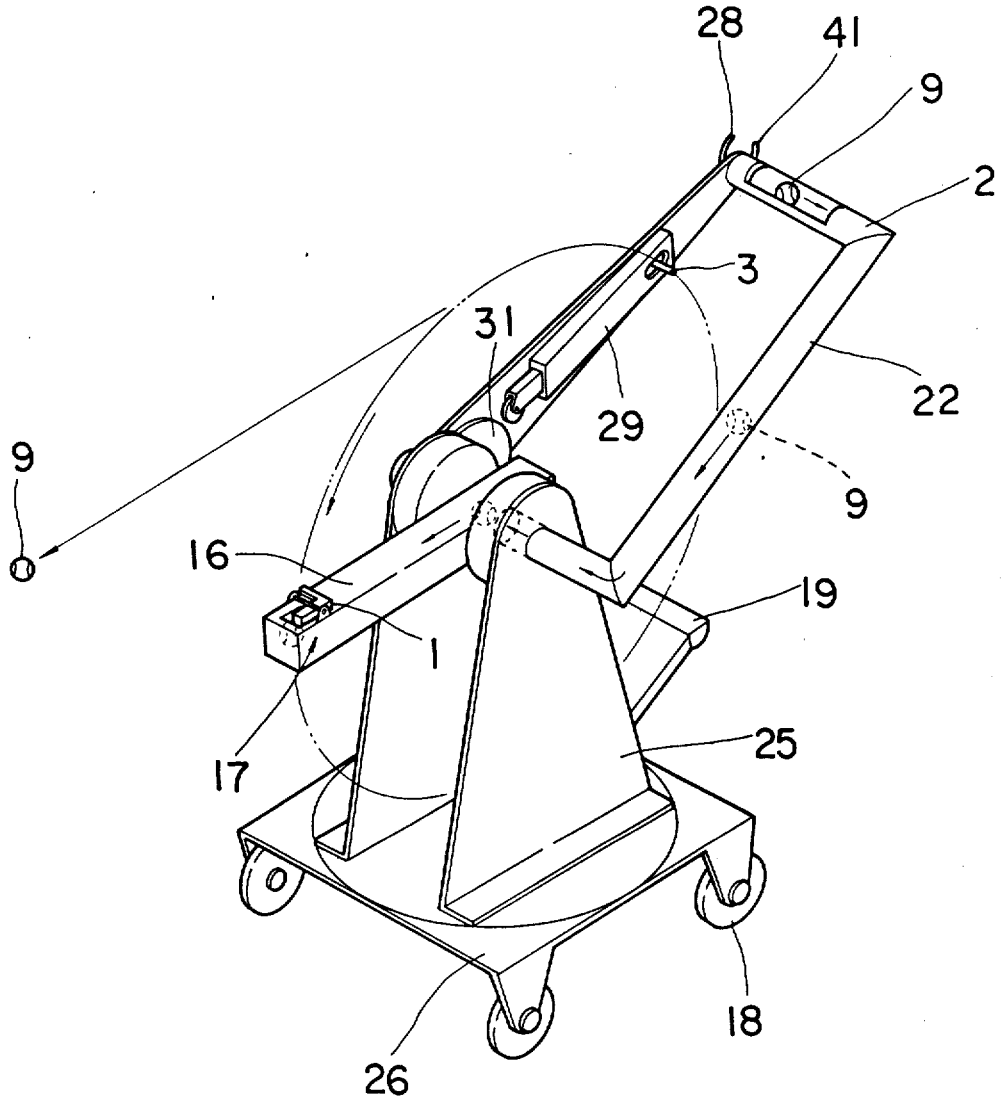
FIGS. 2–10 show the ball throwing apparatus according to the present invention driven and controlled manually.
Figure 3:
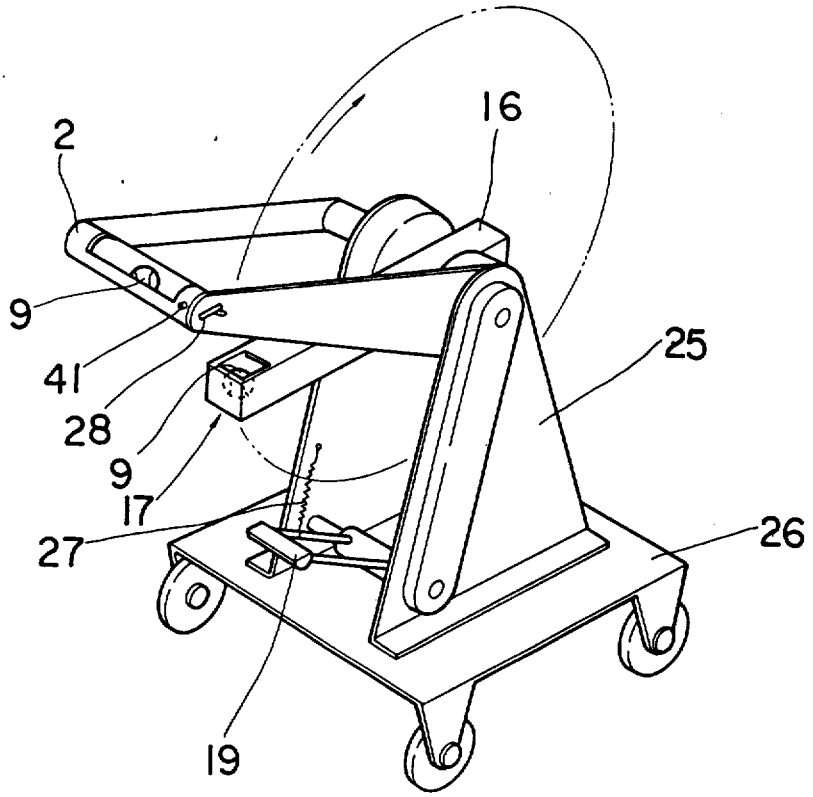
Figure 4:
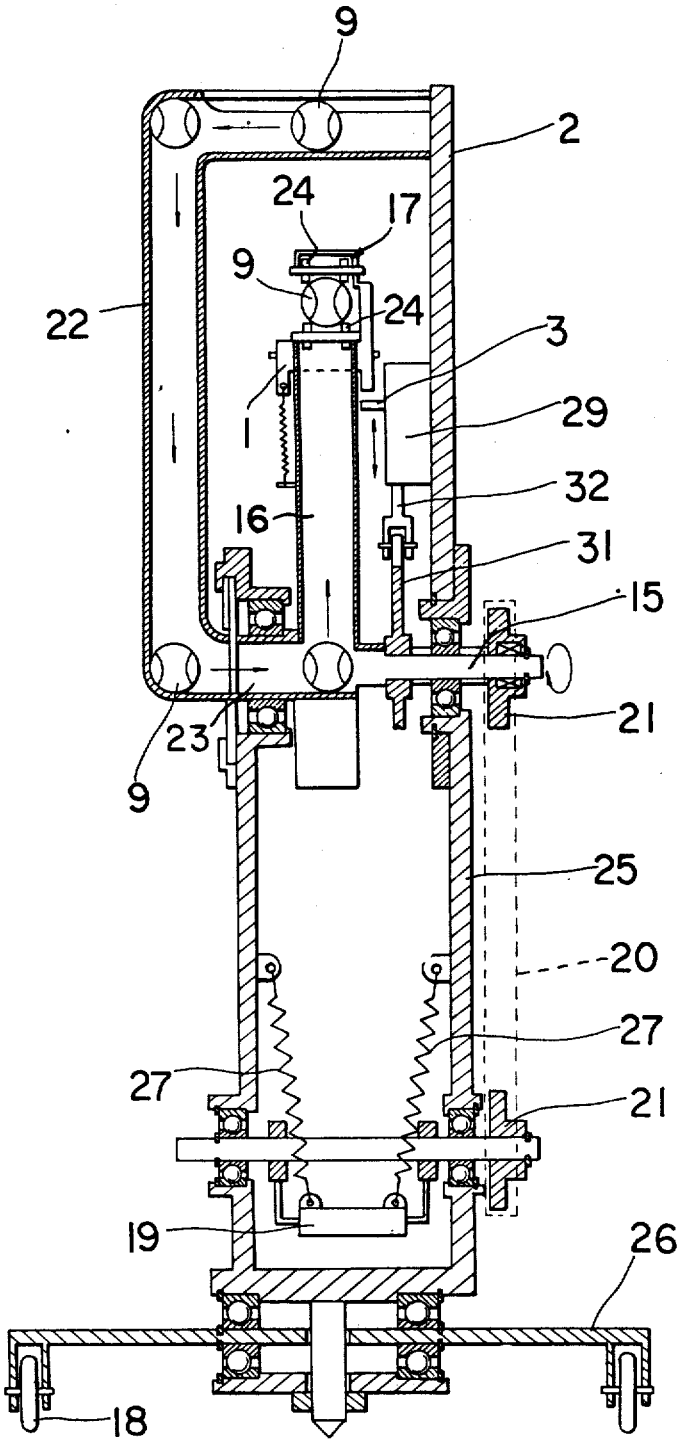

FIGS. 2 and 3, show diagrams illustrating the external appearance of the apparatus of the present invention, in which the fundamental composition of the apparatus, which is manually driven and controlled, is shown. In FIG. 4, a sectional view showing the mechanism of the apparatus of the present invention is given. The present apparatus, having wheels, can be easily moved to any desired place. When a pedal 19 is worked by foot, a rotary rod 16, which is a rotary member, is rotated by means of a chain 20 and sprockets 21. If a ball 9 is put into a half cut out portion of an operating lever 2, the ball falls down through a pipe being lead to a central axis portion 23. The central axis portion 23 is hollow and connected to the hollow portion of the rotary axis. Therefore, the ball 9 is lead into the rotary rod 16 and is pushed by the centrifugal force against a holding member 17 at the top of the rotary rod 16, thus holding the ball 9 in place.

The holding member 17 has a structure for receiving the ball with rollers 24. When the rollers 24 are rotated the ball is rotated and held by the rollers 24 of the holding member 17.

The operating lever 2 is connected to a supporting member 25 at the center axis portion of the rotary rod 16 by a ball supplying pipe 22 freely rotatably on the central axis. The supporting member is provided on a base 26 which is freely rotatable. By working the operating lever 2 up and down, and right and left, the direction of the plane of the rotation of the rotary rod can be varied. Furthermore by varying the angle of rotation of the operating lever 2, the angle of the ball throwing can be controlled in the following way.

Figure 5:
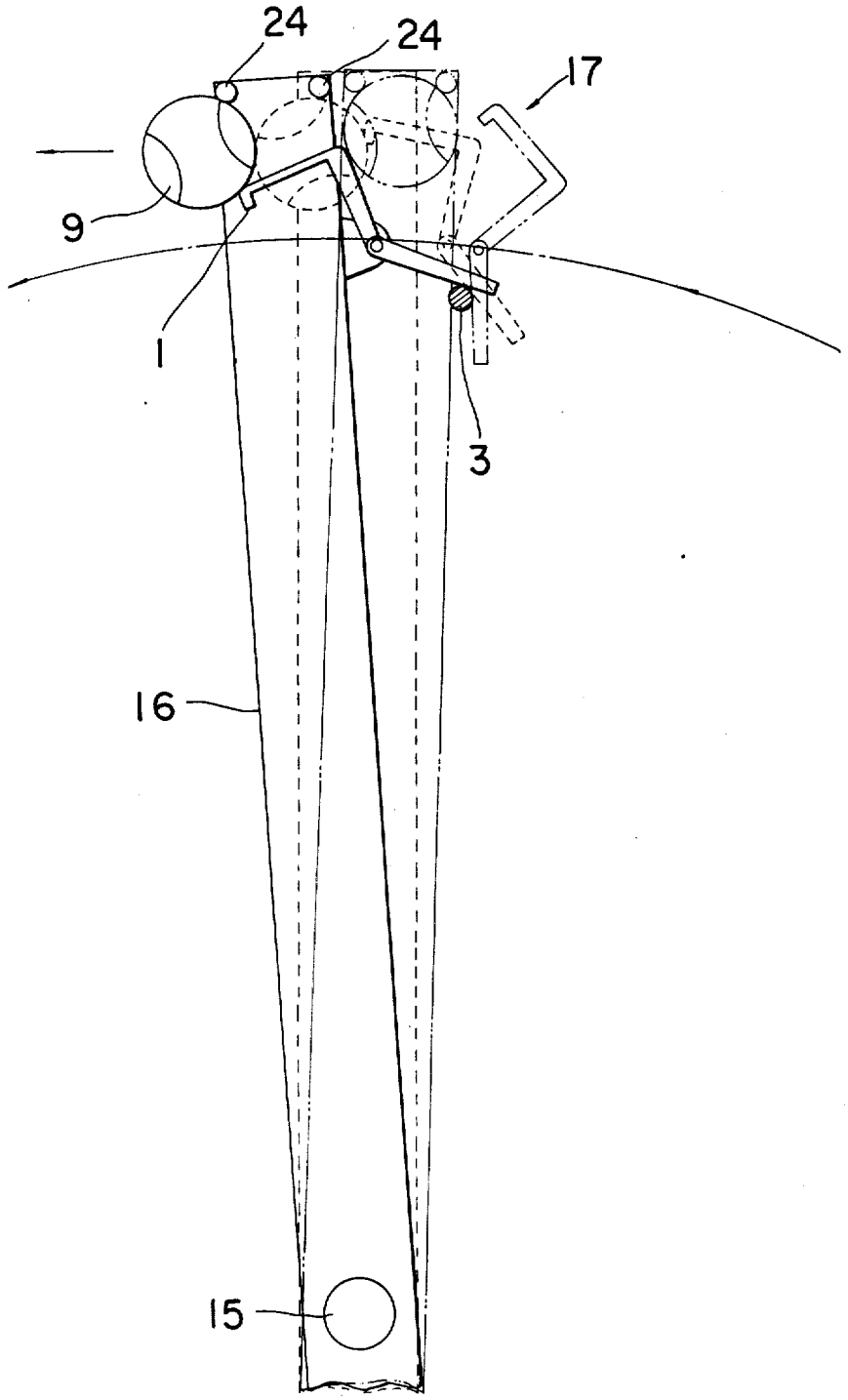

The ball is held by pairs of rollers 24 at the holding member 17 at the top of the rotary rod 16 as shown by broken lines in FIG. 5. The ball 9, which is held here, is projected out from the holding member by the action of L—type projecting lever 1 connected to the freely rotatable rotary rod 16 around the connecting axis. as the projecting lever 1 is pulled always by a spring at the other end, it can project the ball from the rotary rod only when the hook lever 3 (this will be described later) engages with the projecting lever.

The hook lever 3 is projecting on a lever driving member 29 on the operating lever 2 and normally does not engage with the projecting lever 1.

However, if a reset operating lever 41 and a ball throwing lever 28 provided on the operating lever 2 are pulled (refer to FIGS. 2 and 3), only during one rotation at this instant, the hook lever 3 is moved so that the extent of its displacement becomes maximum at that exact instant that the rotary rod passes the hook lever driving member on the operating lever in synchronism with the rotation of the rotary rod. At this time, as shown in FIG. 5 the hook lever 3 engages the other end of the projecting lever 1 on the rotary rod and rotates the lever, projecting the ball out from the rotary rod as shown in a solid line in the drawing. The ball flies in the tangential direction of the locus of the circle during rotation on its axis at that instant that the ball is projected from the rotary rod. The point for projecting the ball, that is—the angle of travel of the ball is determined by the angle of rotation of the rotary rod at the time it engages with the projecting lever, i.e.—the angle of rotation of the operating lever. Thus, the angle of travel and the direction of the ball can be determined mechanically by the direction and the angle of the operating lever.

The operation of the hook lever in synchronism with the rotation of the rotary rod can be realized by combining an eccentric disc, a lever cam and the like.

Figure 6:
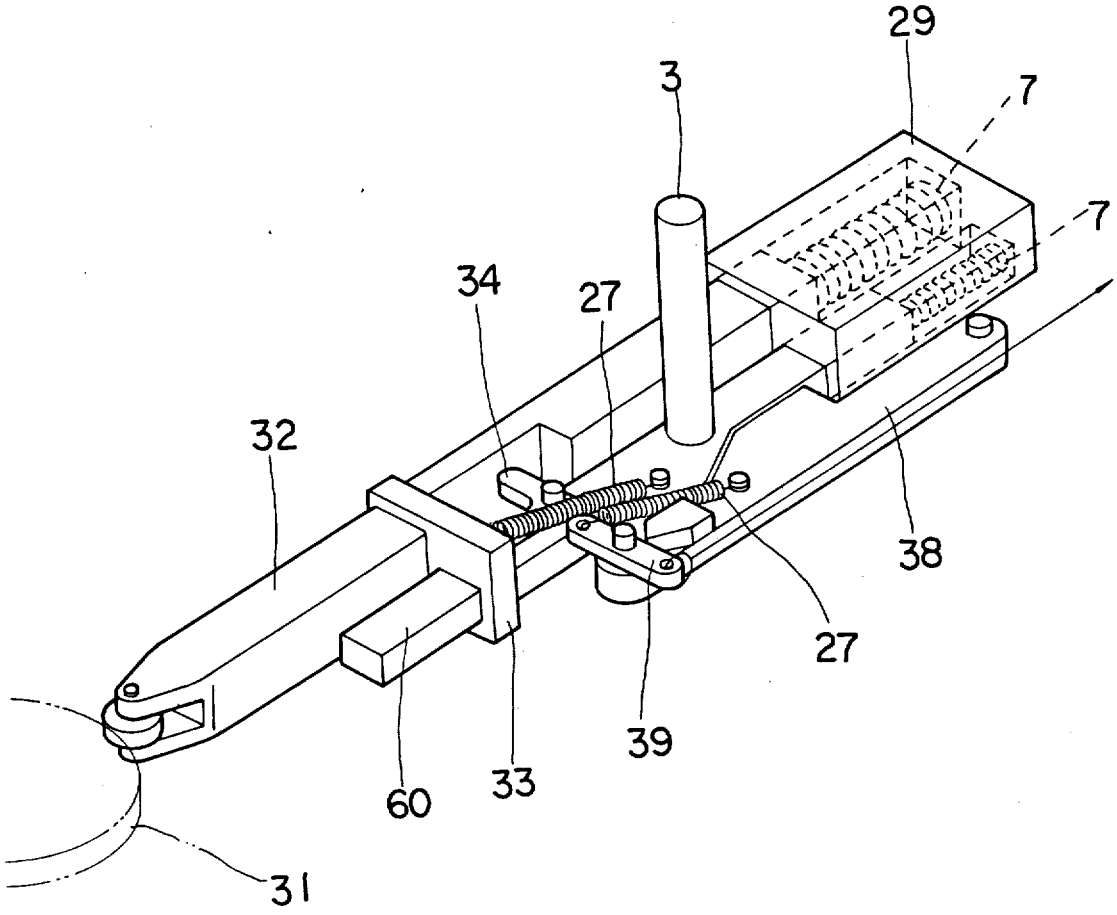

FIG. 6 shows the external appearance of a hook lever driving member 29 constructed with a sliding rod 32.

An eccentric disc 31 is fixed at the member of the axis of rotation of the rotary rod. Said sliding rod 32 is alway pressed against the periphery of the eccentric disc through a roller by springs 7 in the driving member. The lever driving member 29 is provided on the operating lever 2 and the sliding rod is slid in a radial direction within the operating lever 2 in synchronism with the rotation of the rotary rod.

If the eccentric disc 31 is set so that the length of travel of the sliding rod in the radial direction becomes maximum when the angle of the rotary rod is in accord with that of the operating lever 2, the sliding rod would slide so as to make its displacement maximum when the rotary rod passes over the operating lever.

Figure 7:
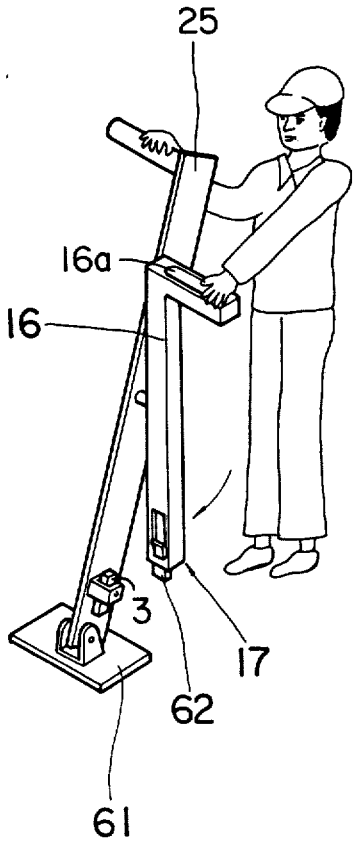

In case it is not necessary for the ball to be thrown quickly, that is—when the ball is to be thrown softly, the ball can be thrown by the ball throwing apparatus as shown in FIG. 7.

In this apparatus the supporting member 25 is equipped on a base 61. In this embodiment, the supporting member 25 also serves as the operating lever. A hook lever 3 projects from the side of the operating lever. A manually operated rotary rod 16 is arranged so as to be freely rotatable on an axis in the middle of the side of said supporting member 25. The hook lever 3 is fixed to engage with the projecting lever at the lower end of the rotary rod when the top of the rotary rod is quickly pulled to rotate the lower end of it in the direction of arrow. If rotated in the opposite direction, the hook lever is brought back to the right side in the drawing and the rotary rod can pass without any resistance. Accordingly, the hook lever hooks the projecting lever of the rotary rod only when the ball is projected out from the rotary rod. But while the rotary rod is being restored, the hook lever is to turn sideways.

In the present ball throwing apparatus the ball is put in the upper end portion 16*a* of the rotary rod 16. The ball falls to the ball holding member 17 at the lower end of the rotary rod after passing through the hollow passage of the rod. The projecting lever 1 is provided at the holding member. The projecting lever projects out the ball held at the top of the rotary rod by being hooked by the hook lever of the supporting member.

The angle of projecting the ball can be easily varied by manually adjusting the degree of inclination of the supporting member functioning as the operating lever. This embodiment of a ball throwing apparatus in accordance with the pesent invention can not throw the ball quickly; however, the embodiment is a very simple mechanism utilizing the fundamental principle of the present invention and can be manually operated in every respect and carried easily.

Figure 8:
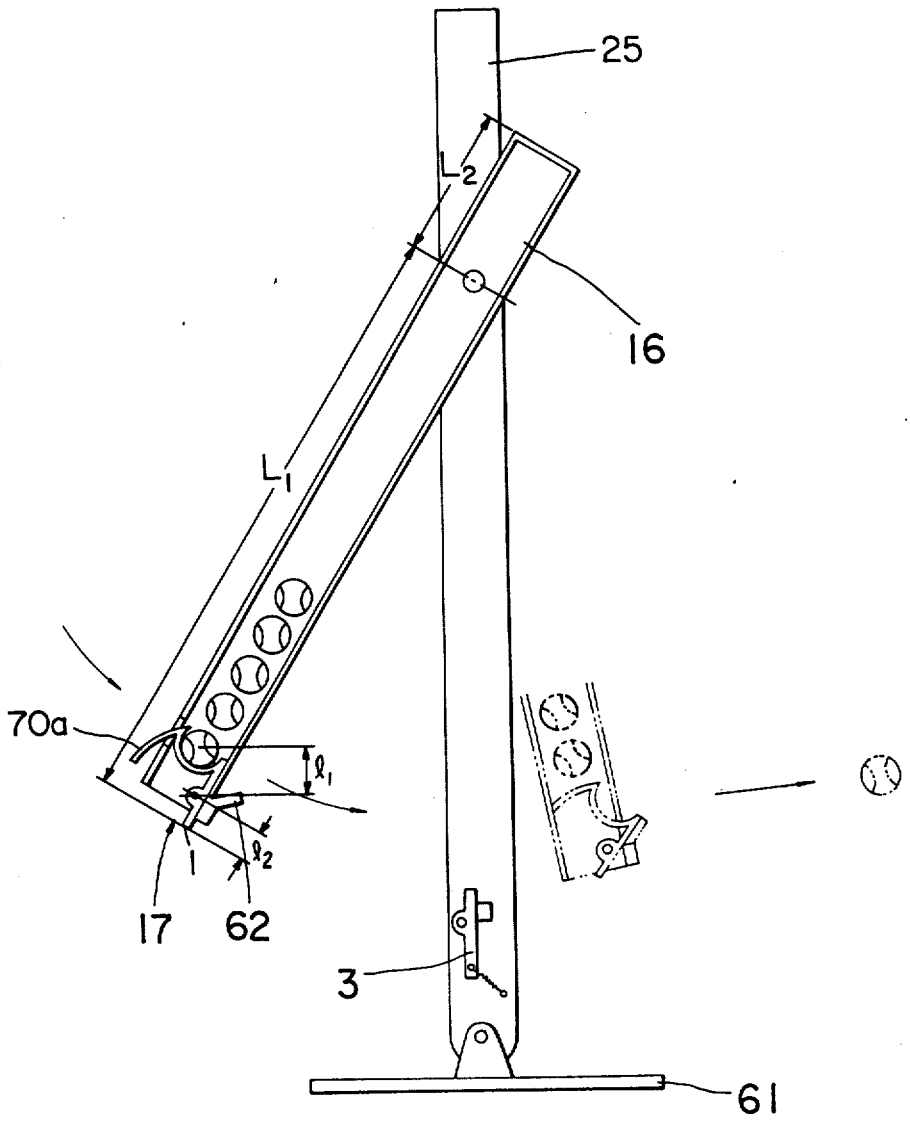

Although the description above is for projecting a ball which held by the holding member at the top of the rotary rod, the holding member and the projecting lever may be unified. An example of such a unified configuration is shown in FIG. 8. A portion of the projecting lever is indented into the shape of a bowl so as to hold the ball in it. The ball is thrown out from the projecting lever when the projecting lever hits the stopper 62 as shown in FIG. 8.

When the rotary rod 16 rotates and the hook lever 3 of the supporting member 25 serving as an operating lever hits against the projecting lever 1, the projecting lever rotates such that the stopper 62 stops the rotary motion of the projecting lever 1, as shown in the diagram, and the ball can be projected out from the rotary rod being accelerated.

As the ratio of the distance from the center of rotation of the projecting lever to the center of the ball held in the projecting lever $l_1$ and that from the center of rotation of the projecting lever to the portion contacting with the hook lever 3 $l_2$ becomes larger, (i.e.—assuming that $l_1/l_2 > 1$), the ball can be projected out at a speed which is greater than the peripheral speed of rotation on its axis. If the lever ratio of the rotary rod is expressed as $L_1/L_2$ as shown in FIG. 8, the ball can be thrown at a speed which is $L_1/L_2 \times l_1/l_2$ times as high as that effected by manual operation of the lever.

If the holding member 17 and the projecting lever 1 are unified, the impulse force caused when the hook lever strikes against the projecting lever does not act directly on the ball; therefore, the direction of the projection of the ball is controlled accurately.

Figure 9:
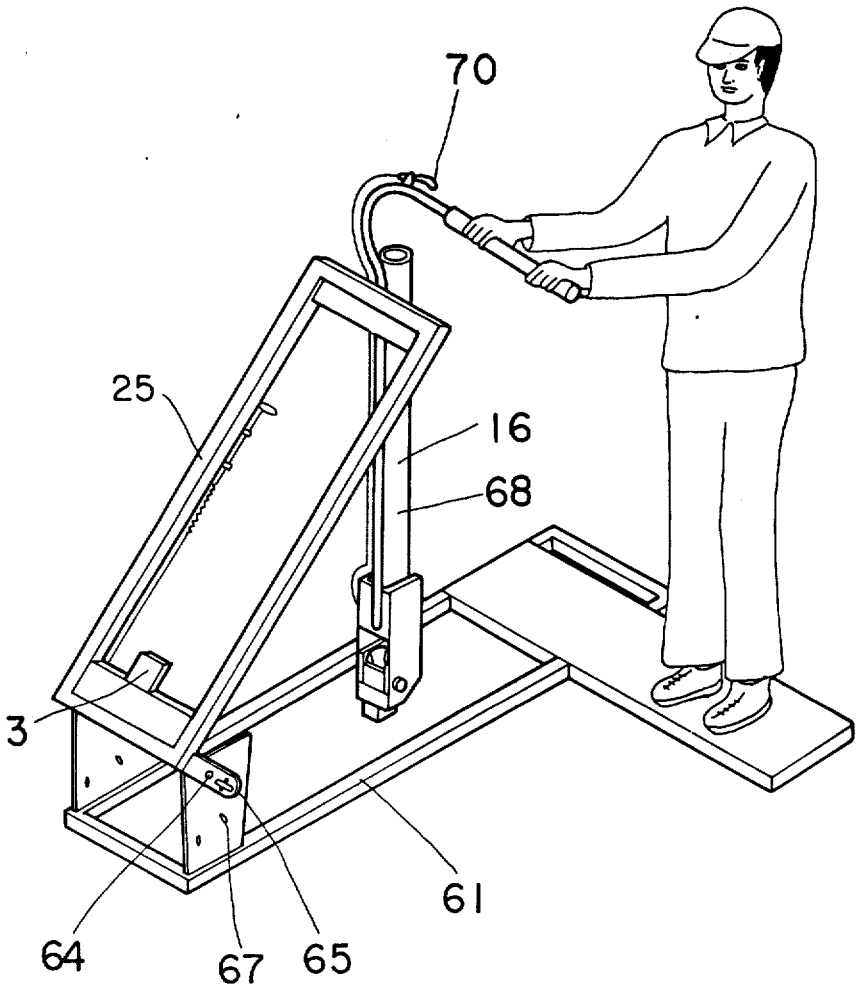
Figure 10:
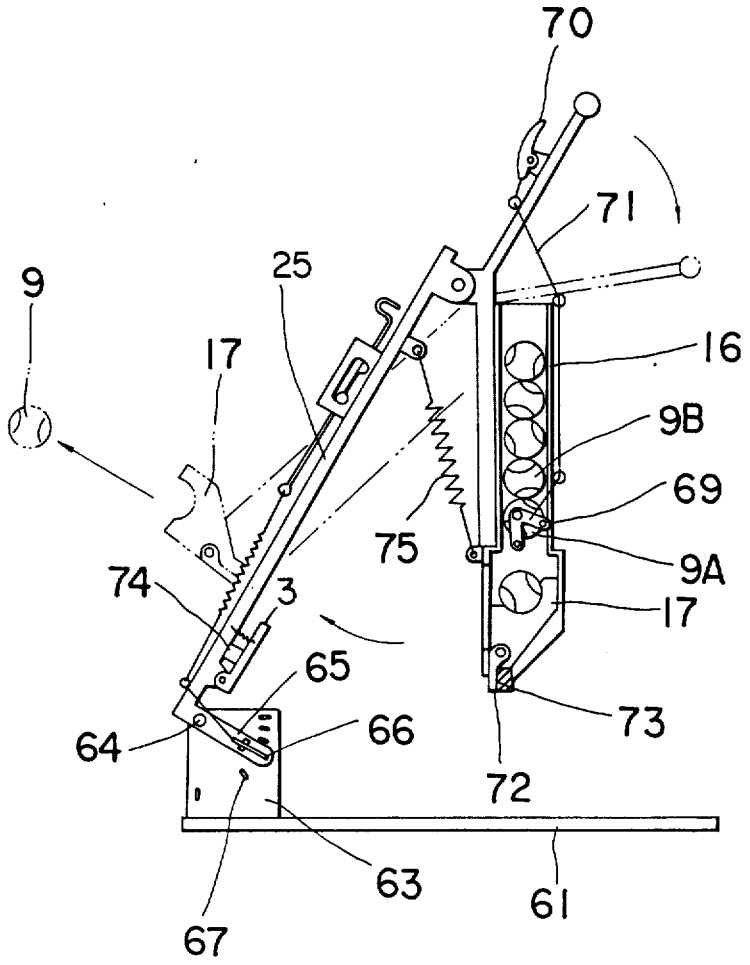

FIGS. 9 and 10 show another embodiment of the manual ball throwing apparatus according to the present invention. The apparatus is provided with an impulse relieving means, such as a rubber member, located between a holding member 17 at the top of the rotary rod which is a body holding means and a hook lever 3, which is a releasing means, and having a spring 75 for accumulating the energy of rotation of the rotary rod between the rotary rod 16 and a suppporting member 25 serving as an operating lever. The rotary rod is hollow so as to hold many balls within it. Furthermore, a stopper 69 is provided for supplying ball one by one to the holding member. A ball supplying lever 70 attached to a handle operating the rotary rod operates by means of a wire the stopper 69 located within the hollow cylinder 68 which is united with the rotary rod. In the cylinder, many balls are arranged in a line, and are prevented from going to the holding member by the stopper. Pulling the ball supplying lever rotates the stopper 69 about 90° degrees, and only a ball 9A at the head of the line falls into the holding member 17. The holding member 17, which is is attached so as to be freely rotatable, is attached to the end of the rotary rod by an axis having a lever 72 which is provided with a rubber member 73. When the handle is sharply pulled to the side of the operator for rotating the rotary rod quickly to the side of the supporting member 25, the lever 25 strikes against the hook lever 3, and the holding member rotates as shown in a broken line, throwing the ball in the direction shown by an arrow.

At this moment, as the speed of rotation of the rotary rod is added to that of the holding member itself, the ball is accelerated so much that it is projected out at a high speed. The hook lever and the supporting member 25 are respectively provided with a buffer 74. When the holding member strikes against the hook lever because of the rotation the rotary rod, said buffer 74 and the rubber buffer member 73 on the side of the holding member reduce the impulse force therebetween, and the energy of rotation is effectively transformed into the energy for causing the ball to travel.

Between the supporting member 25 and the rotary rod, an elastic member, such as a spring 75, is provided. The spring 75 is set so that the energy stored at the position of the rotary rod when the holding member contacts the hook lever is at its minimum.

When the handle is pushed forward and the rotary rod is lifted, the energy is stored in the spring.

When the rotary rod is rotated by pulling the handle, the stored energy is added to the energy of rotation and the ball is thrown in such a state that the speed of rotation is increased to its maximum.

An angle setting plate 63 is fixed on the base 61. The supporting member 25 is supported so as to be freely rotatable on the axis provided on the angle setting plate. By inserting a coupling pin 66 in any one of the holes 67 on the angle setting plate, the supporting member 25 can be fixed to the base 61 at a desired angle.

In the embodiments described above, the apparatus is manually driven and controlled mechanically. If an electrical method is partially employed, as will be described hereinafter, the mechanism of the apparatus is made simple. If the hook lever 3 is operated by an electro-magnetic means, such as a solenoid 43, as shown in FIG. 11, the eccentric disc, the sliding rod, the hooking rod, the ball throwing rod and the mechanism related to these elements are not required.

Figure 11:
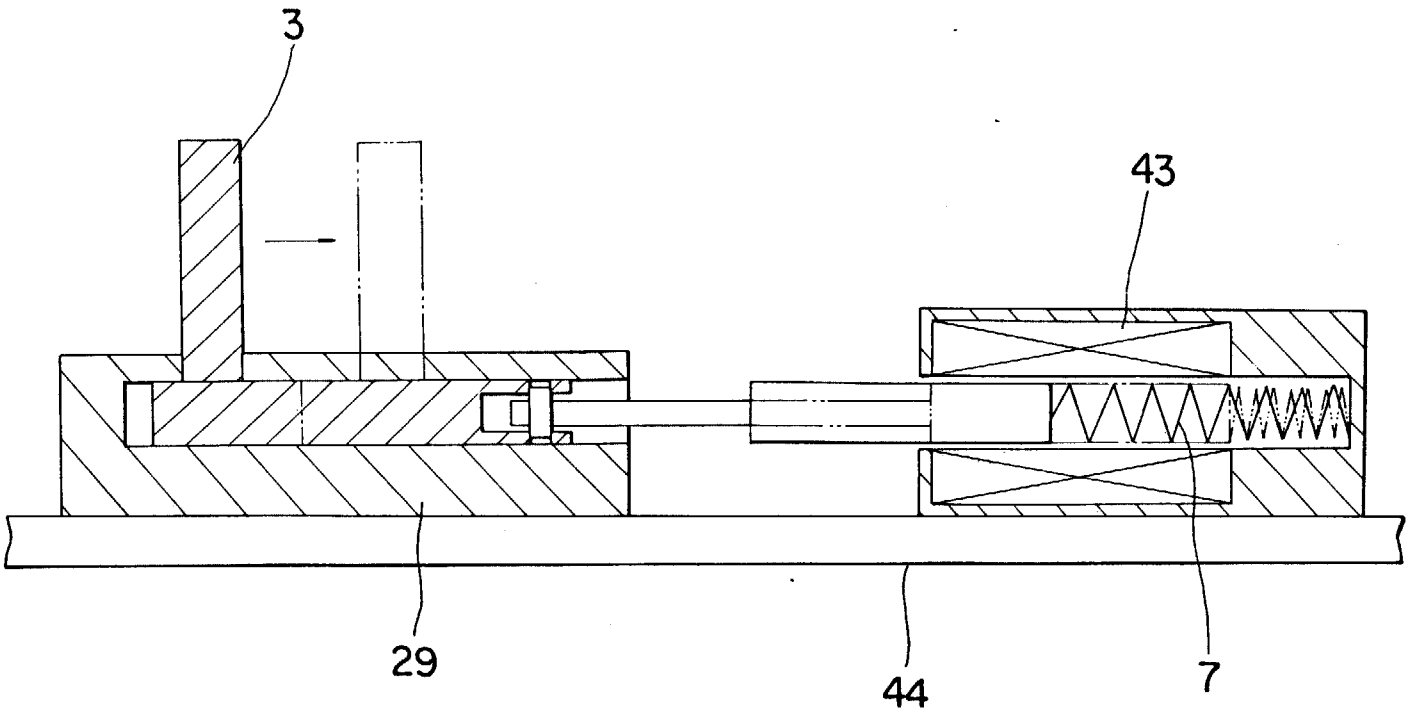
FIGS. 11–18 show a ball throwing apparatus of the present invention which is driven electrically.

FIG. 11 shows a structure comprising a hook lever 3 which is capable of sliding within a guide rail 44 connected to the solenoid 43. The hook lever moves to the right when the current flows through the solenoid, and it is pushed back to the original position by a spring 7 if the current is cut off.

Figure 12:
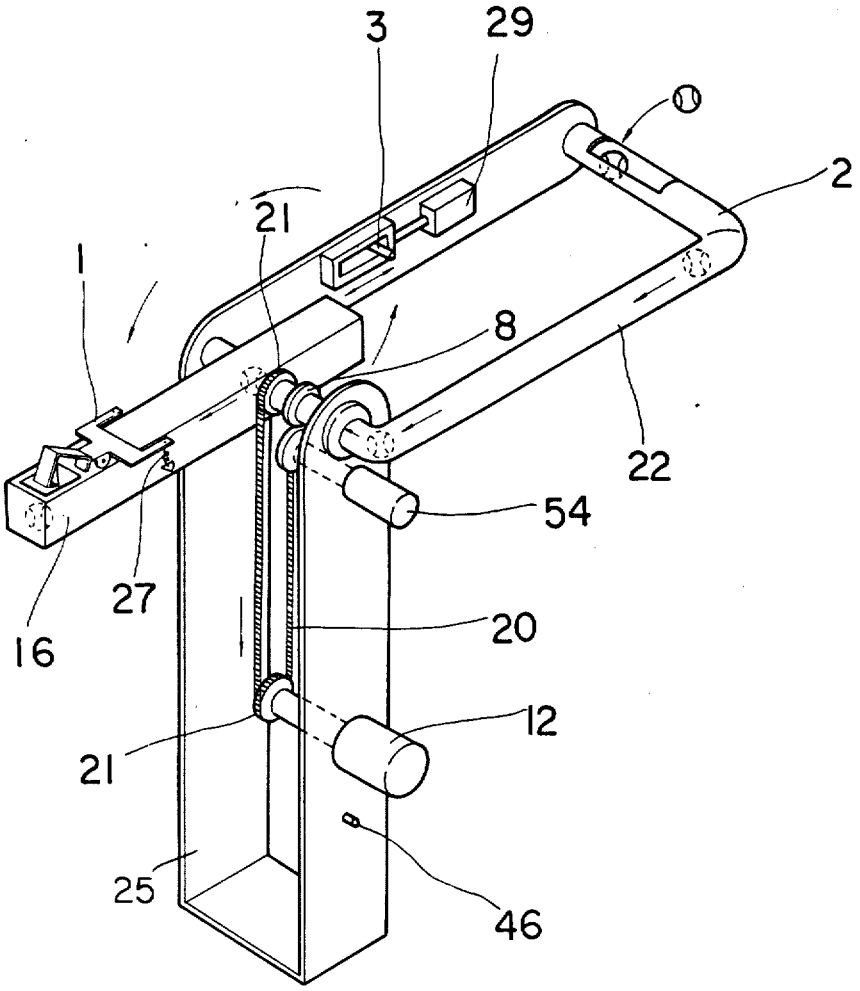

FIG. 12 shows the external appearance of a ball throwing apparatus fitted with an electric means. The rotary rod 16 is driven so as to rotate by an electric motor 12 through a chain 20. The angle of rotation of the rotary rod is detected by a detector 54. When an instruction for throwing the ball is given by pressing an operating button, the angle of rotation of the rotary rod is detected, the solenoid is driven taking the speed of rotation, the lag in driving the solenoid, the time for operation and the like into consideration. The ball is thrown by being projected out from the rotary rod 16 by hooking the projecting lever 1 attached to the top of the rotary rod with the hook lever 3 when the rotary rod passes in front of the operating lever after the hook lever is moved outward in the radial direction before the end of the rotary rod 16 passes the operation lever. The angle of the rotary rod can be deduced from the speed of rotation and the time elapsed after the rod passed if the point where the mount is held and the time the rotary rod passes are detected by a photo sensor 46 and the like, as shown in the diagram, and without the necessity of constantly measuring the angle of the rotary rod. While an electrical control device is required to coordinate the detecting the rotation of the driving motor 12 and the angle of the rotary rod, and the driving the solenoid, the apparatus is, however, made simple mechanically.

In the ball throwing apparatus with an electrical means as described above, the angle of rotation when the ball is projected from the rotary rod can be determined mechanically with exactness by the angle of rotation of the operating lever.

Since the operating lever is out of the rotating member and in a nearly static state, it is easily operated.

Figure 13:
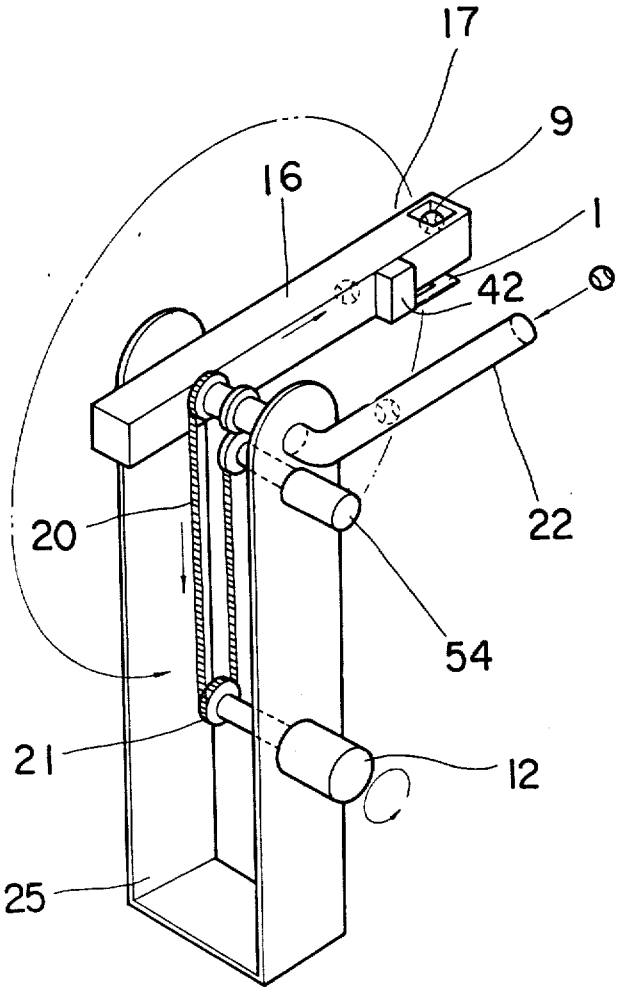
Figure 14:
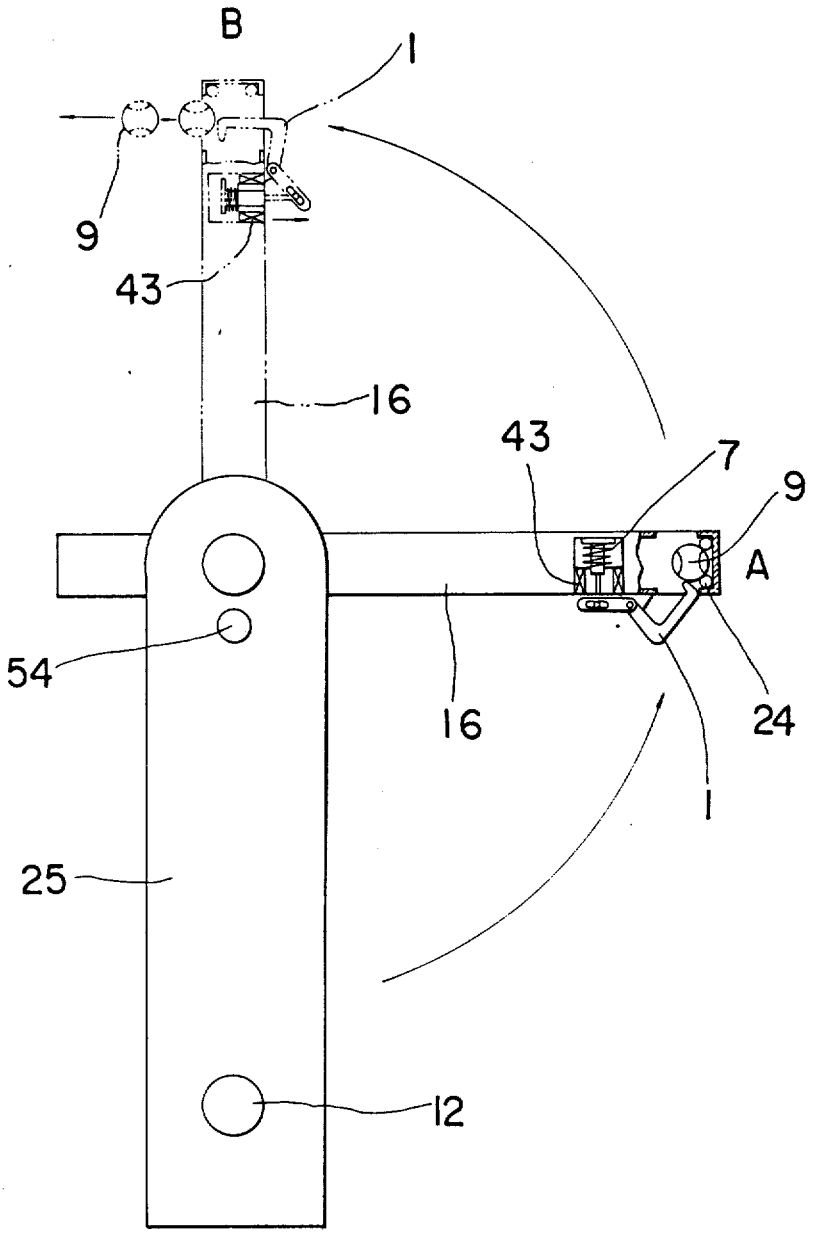

FIGS. 13 and 14 show an apparatus with a lever driving member 42 mounted on the rotary rod 16. In this apparatus the operating lever is not required. While the time lag in the operation of the projecting lever 1 and variations in the time of operation reduce the exactness of the ball throwing, requiring no operating lever makes the mechanism very simple mechanically.

As shown in the diagram, a ball supplied from the ball supplying pipe 22 is lead to the hollow passage of the rotary rod through the hollow member of the axis of rotation, and is pressed against the ball holding member 17 provided at the top of the rotary rod by means of the centrifugal force. The ball 9 is held by rollers 24 in the ball holding member as shown at A in FIG. 14. The ball 9 is projected out of the rotary rod when the projecting lever 1 is driven by a solenoid 43 connected to the projecting lever 1, as shown at B of FIG. 14. The solenoid 43 for driving the projecting lever may be supplied with an electric current by means of a slip ring and the like through the member of the axis of rotation.

Throwing the ball out from the rotary rod may be effected by ceasing to hold the ball at the holding member supporting it excepting the method of projecting as described above. For instance, in the case of holding the ball by placing it between rollers at the holding member, if the holding of the ball is released, the centrifugal force acting on it being released, making it travel in the direction of the locus of the circle of the ball at the moment of release.

In sports such as baseball, tennis, ping-pong and the like, the ball is curved by providing it with rotation; therefore, a function of throwing the ball while rotating it is necessary for employing the present apparatus for training.

Throwing the ball while giving it a spin is effected by making it rotate before being thrown. In the present apparatus, the ball is kept down by the centrifugal force in the holding member provided at the top of the rotary rod; accordingly, if rollers are provided for supporting a ball in the holding member and these rollers are rotated, the ball can be rotated.

Figure 15:
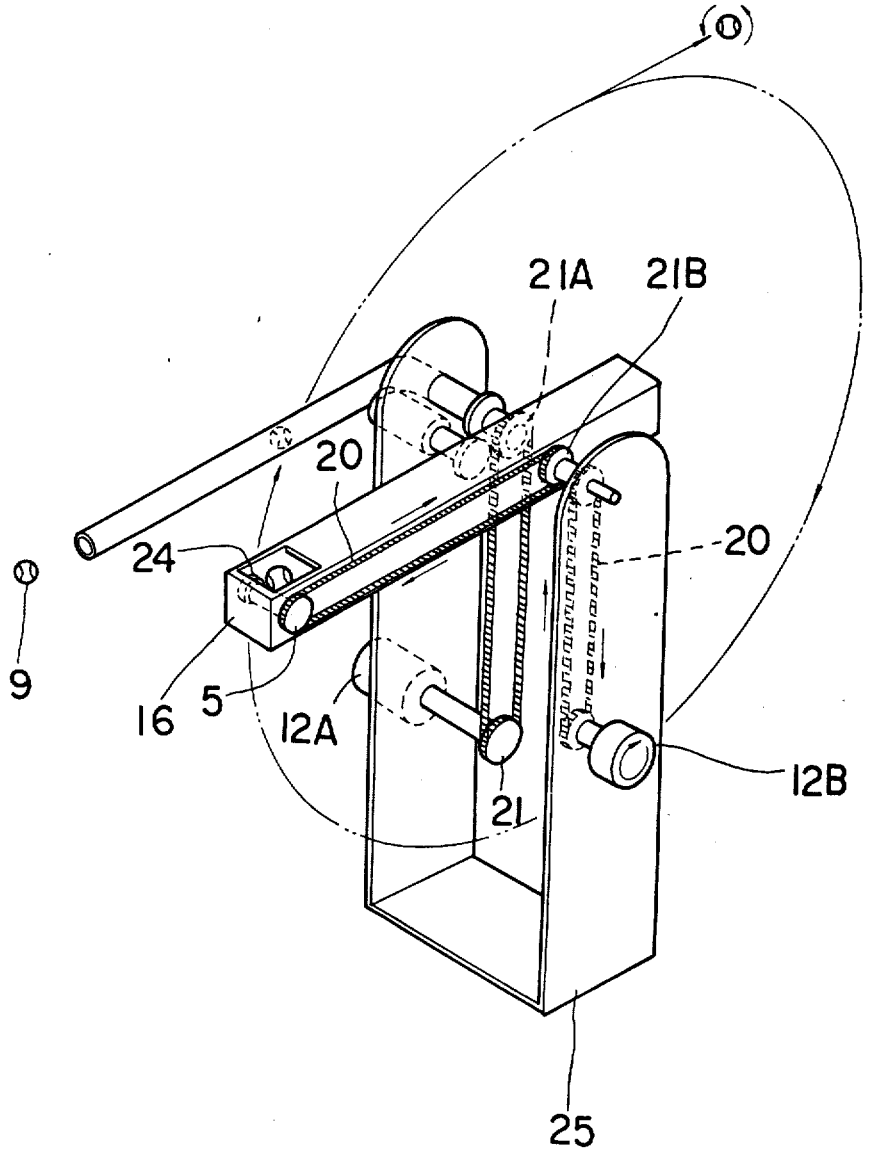

A driving mechanism for rotating the ball is shown in FIG. 15. Respective rotations of motors 12A and 12B are transmitted to sprockets 21A and 21B through chains 20 or timing belts. The sprocket 21A rotates the rotary rod on the fixed axis of rotation. The other sprocket 21B on the side of the rotary rod is attached so as to be freely rotatable against the rotary rod, and it therefore rotates without reference to the movement of the rotary rod. The rotation of this sprocket is transmitted to a roller 24 at the holding member through another chain or timing belt. The ball is rotated on its axis by the rotation of the roller while it is held. Thus, the ball rotates on its axis in the holding member while it is revolved by the rotary rod.

If the rotary rod is rotated and the motor for rotating the ball is made stop, the roller is rotated in the reverse direction to that of revolution when the chain or timing belt is winding around the sprocket on the side of the rotary rod. The ball supported by the roller is rotated in the same direction as that of the revolution. If the motor for rotating the ball on its axis is turned either normally or inversely, the rotation of the motor is transmitted to the roller in the holding member, and the ball can be rotated at a speed which is either reduced by or added to the speed of the roller caused by the rotary rod. When the motor is operated in the direction shown in FIG. 15, the roller is driven in the direction for reducing the rotation of the ball and if the speed of rotation of the motor is set at the suitable value, it can be stopped completely. If the motor is turned inversely, the ball can be rotated quickly in the direction of revolution. Thus, the direction of rotation and the speed of rotation of the ball which is being revolved by the rotary rod can be freely controlled by controlling the speed of rotation of the motor.

Figure 16:
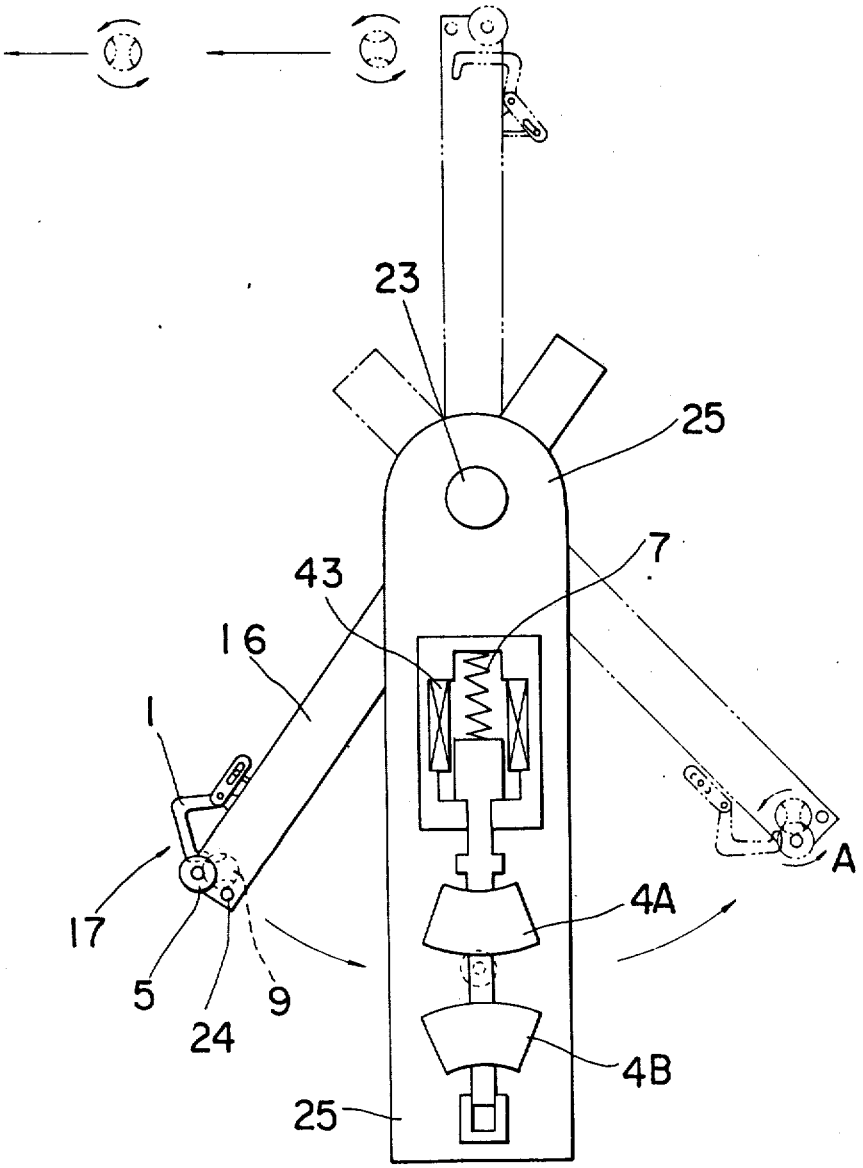

The roller in the holding member can be mechanically rotated from the outside instead of rotating it by the electric motor in a way which will be described hereinafter. As shown in FIG. 16, a small wheel 5 is provided on the outside of the rotary rod which is directly coupled with the roller 24 of the holding member 17 at the top of the rotary rod. Spin controlling plates 4A and 4B are provided at a position where the wheel can roll when the rotary rod passes along a locus generated by the wheel during the rotation of the rotary rod. The spin controlling plate is always pressed down on the supporting member 25 by a spring. It can be lifted up when a solenoid is supplied with an electric current. If the rotary rod is rotated when the spin controlling plate is being pressed down, the roller of the holding member rolls on the upper spin controlling plate 4A, is rotated in the direction as shown by an arrow A in FIG. 16 and is able to cause the rotation of the ball in the inverse direction. If the spin controlling plates are lifted up by the solenoid, the roller rolls over the lower spin controlling plate 4B, and the ball is rotated inversely to the direction described above.

In this apparatus, the direction of rotation of the ball on its axis can be varied freely; however, the speed of rotation can not be controlled as the apparatus described before. But, the mechanism can be made guite simple.

In the ball throwing apparatus according to the present invention, the projecting speed or the travel speed, the angle of projection or the direction of travel, and the direction and the extent of curve of the ball can be varied freely, and controlled exactly.

Accordingly, if these conditions can be controlled by a control device having memories, arithmetic processing functions such as that provided by a computer, excellent games which have been recorded can be shown again and the apparatus can be used as a substitute for an excellent pitcher for performing the same pitching as performed by him and for playing the same game as before. For an object like this, the driving member must operate automatically.

Figure 17:
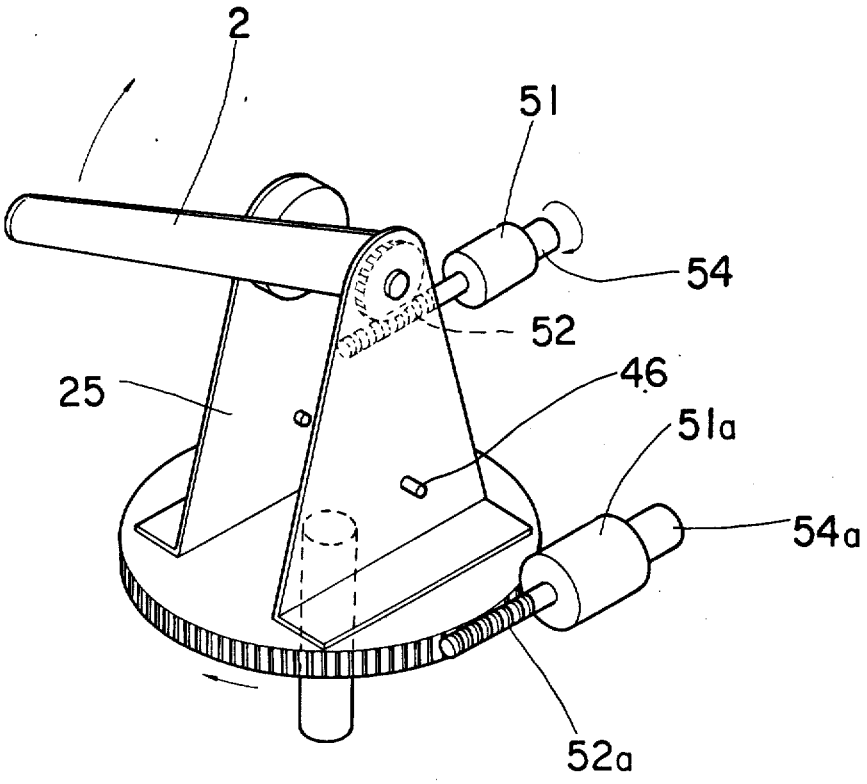

FIG. 17 shows a configuration and an arrangement in which the operating lever 2 is driven through a worm gear 52 by an electric motor 51 and a base 25 is driven by another motor 51*a*.

Further, for making the apparatus automatic, the rotation of the rotary rod and the rotation of the roller in the holding member must be effected by an electric motor. The detector for position or speed must be provided for any driving member described above.

Figure 18:
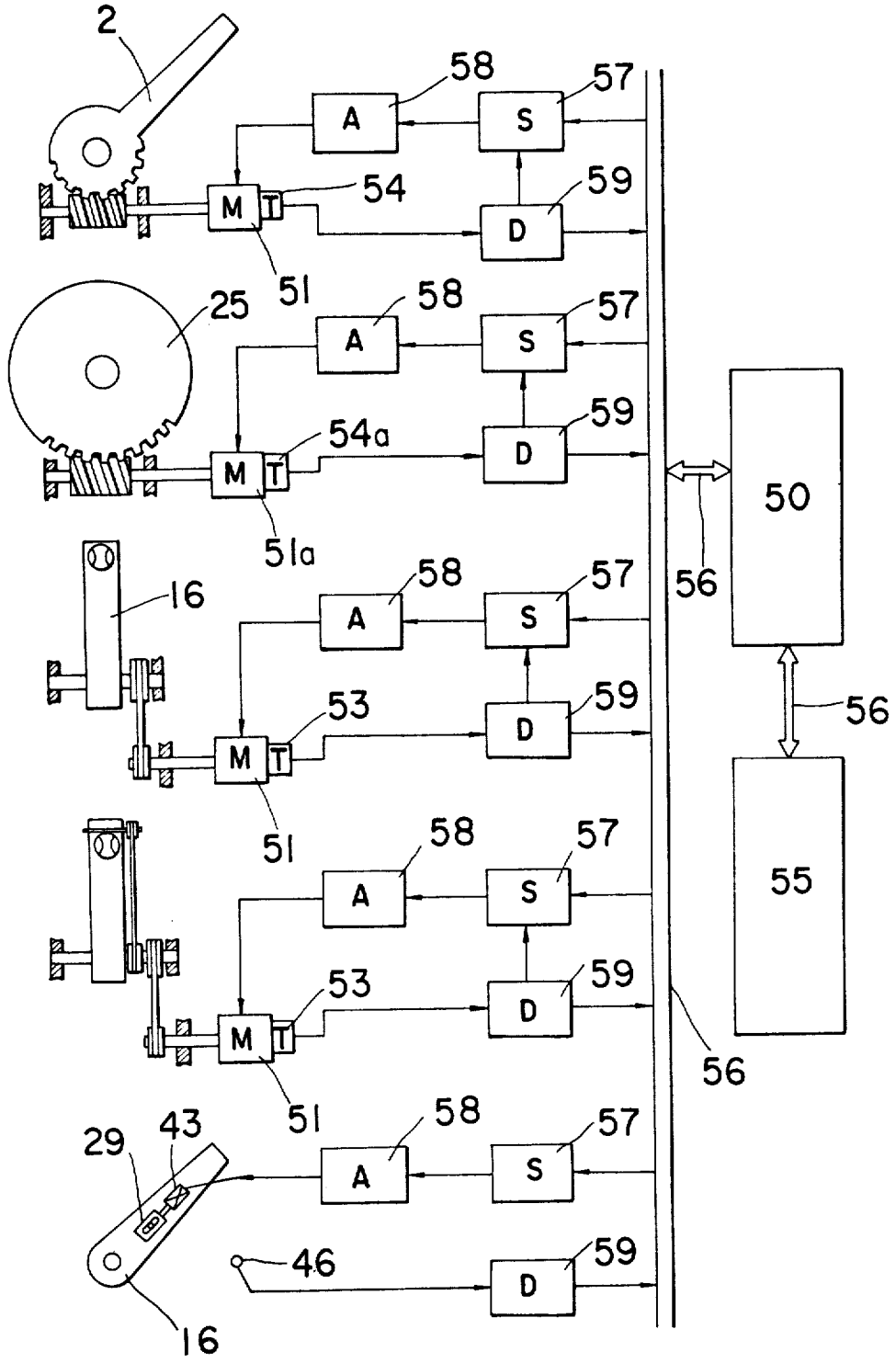

A position detector is employed in the operating lever and the base, and a speed detector in the rotary rod and the driving member of the roller at the holding member. Moreover, a photo sensor 46 as shown in FIG. 17 is required to detect the moment the rotary rod passes by, and a solenoid for operating the hook lever is also necessary. The whole configuration is as shown in FIG. 18. When the position or the speed instruction is given to any driving member through bus lines 56 and interfaces 57 from the control device composed of a computer 50 with a memory 55, the information related to the position or the speed from the detector is detected. The information is fed back for operating the driving circuit, and the correct motor is driven so that the instruction provided by the computer is effected. Thus, each driving member is accurately controlled according to the instruction given, and therefore, the exact ball throwing action can be realized.

The computer can read the positions of the operating lever and the base, the speeds of the rotary rod and the roller of the holding member and the like. Data obtained when the training is carried in configuration with the ball throwing apparatus can be stored.

As described before, the ball throwing apparatus of a cannon type for performing the ball throwing by instantaneously discharging the energy stored in a compression spring and an apparatus of a cam system type in which throwing is performed by rotating the arm with the energy stored in a compression spring are difficult to control with respect to the direction and the speed of travel of the ball since the energy is supplied to the ball in an instant.

The energy necessary for throwing the ball is small and almost all of the energy stored may act on the main body of the apparatus as a large impulse force. For reducing the impulse force, the apparatus has to be made heavy or fixed to the ground. Furthermore, for storing energy in the compression spring, a strong driving force is required and such an apparatus can not be driven manually. This is a main reason for that it can not be brought to any place out of doors easily and used conveniently.

In the ball throwing apparatus of the tires system type heretofore in use, a large impulse force does not act on the ball. The friction between the ball and the tires at the moment the ball is pressed into the tires and the adhesive force at the moment the ball is thrown out from the tires significantly affect the direction of travel and the speed of the ball. Therefore, it is hard to exactly control various balls whose extent of wear are different.

For throwing the ball accurately, it is ideal that the ball is thrown by varying its locus of projection without giving a rapid change to the ball while keeping it in a state of the steady motion. The ball throwing apparatus according to the present invention is developed so as to be based upon such a fundamental principle as described above. That is, the ball is rotated in the predetermined direction and at the predetermined speed for letting it curve in the direction and at the extent which has been predetermined; the ball is then rotated at the predetermined speed in the plane of rotation which has been predetermined. The ball is released from the centrifugal force at the predetermined angle of rotation. Then, the ball can be thrown at the circumferential speed at the time of rotation, keeping the rotation given at the time it is rotated on its axis, in the tangential direction of the locus of the circle of the revolution when it is released from the centrifugal force.

For revolving and rotating the ball, it may be sufficient that a force overcoming the friction of the driving member is provided. The while driving member of the ball throwing apparatus of the present invention utilizes roller bearings for making the friction small.

The driving force required for the present apparatus is so small that it can be operated manually in contradistinction with the prior art apparatus.

The changing of the locus from the rotational motion into the linear motion can be effected by releasing the centrifugal force acting on a rotating body. That is, it can be achieved by releasing it from being held. At this moment, no impulse forces act. Throwing the ball can be effected very smoothly because the present apparatus employs a method as shown above in principle. The present apparatus employs a method of projecting the ball out from the rotary rod which is rotated by the projecting lever. The force for projecting the ball is only a small force for pushing the ball. It is also so small as an impulse force that it is hardly worth consideration. The travel speed of the ball is increased because the speed at the moment of projection is added to the circumferential speed while the ball is revolving. This is a reason why the present system is employed.

The ball throwing apparatus is characterized in that the condition of throwing the ball is not varied instantaneously, and while it is arranged in a steady state or nearly static state, the locus correction is made reasonable for exactly and accurately controlling the throwing condition.

The ball travel speed at the time of projecting the ball from the ball throwing apparatus is determined by the circumferential speed of the ball during its revolution or the speed of rotation of the rotary rod, and the direction and the speed of the ball for curving it is determined by the direction of rotation of the ball on its axis and its speed during the revolution by the direction of rotation and the speed of the ball when it is held by the holding member at the top of the rotary rod which is rotating. These characteristics are exactly and easily controlled.

The direction of projecting the ball from the ball throwing apparatus can be determined geometrically by the plane of rotation of the ball during its revolution. It can be controlled by varying the angle of the supporting member which supports the rotary rod. The angle of the supporting member is controlled exactly and easily because it is done in a nearly static state.

The angle of elevation when the ball is projected out from the apparatus is determined by the angle of revolution of the ball during its revolution when the circular locus is changed into a linear one, that is by the angle of the rotary rod when the ball is projected out from the rotary rod which is rotating. In case of projecting the ball from the rotary rod with the hooking mechanism provided on the operating lever, the angle of rotation of the rotary rod or the angle of elevation when the ball is projected from the rotary rod is determined geometrically by the position of the operating lever, that is—by the angle of rotation thereof because the position of the hook lever and the size of the projecting lever are settled.

The rotation of the rotary rod, and that of the ball at the holding member in the rotary rod can be effected manually, and the direction of the supporting member and the angle of the operating lever are manually adjusted with ease. Moreover, if controlled by a servo mechanism utilizing a control device contained in a computer with an arithmetic means and the memory, a apparatus according to the present invention can be controlled more exactly than if effected manually. As the ball throwing apparatus of the present invention can have its condition for throwing a ball settled in a steady state or static state, it has a distinguishing feature that the same ball throwing mechanism can be used in the case of controlling with the computer used with a control device and that effected manually without changing the mechanism. Since the condition for ball throwing can be varied in a wide range, an extremely slow ball and a speed ball speedier than that pitched by the prior art apparatus can be thrown. In the case of throwing a curve ball, the situation is the same as that noted above.

The wear of the ball is reduced very much in the apparatus according to the present invention because a large force is not applied to the ball instantaneously.

In the present apparatus, the condition of wear, the coefficient of friction, the adhesion and the like do not, in principle, influence the accuracy of the thrown ball.

After projecting the ball, an unbalance corresponding to the lack of mass of the ball is caused, but of little consideration. Therefore, the apparatus according to the present invention can be made small-sized and light in weight, and able to be to carried easily to any plate out of doors.

Although the body which is thrown has been described as a ball hitherto, any body may be used which can be introduced through the passage within the rotary rod. For instance, a shuttlecock for badminton is not a ball, but it can be thrown from the rotary rod by being applied with a suitable pressure through a pipe after it is sent to the top of the rotary rod with a weak compressed air force supplied through the pipe for feeding the ball, and held temporarily in the holding member.

What is claimed is:

1. A ball-throwing apparatus comprising a rotary body having a ball-holding means for holding a ball-like body, said ball holding means being freely rotatably supported on an axis which is fixed on a supporting member, said ball-like body being projected by means of the tangential speed given to said ball-like body by one of either revolving or swinging said rotary body, said rotary body being tubular and having at least one ball-like body projecting port placed at substantially the top edge of said rotary body, and having a passage which is fixed between said at least one ball-like body receiving port and said projecting port, said ball-like body capable of moving in said passage; said ball-like body holding means being arranged near said projecting port; further comprising a projecting means for projecting said ball-like body held by the said ball-like body holding means by accelerating the tangential speed of said rotary body beyond its peripheral speed.

2. A ball-throwing apparatus comprising a rotary body having a ball-holding means for holding a ball-like body, said ball holding means being freely rotatably supported on an axis which is fixed on a supporting member, said ball-like body being projected by means of the tangential speed given to said ball-like body by one of either revolving or swinging said rotary body, said rotary body having at least one ball-like body projecting port placed at substantially the top edge of said rotary body, and having a passage which is fixed between said at least one ball-like body receiving port and said projecting port, said ball-like body capable of moving in said passage; said ball-like body holding means being arranged near said projecting port; further comprising a projecting means for projecting said ball-like body held by the said ball-like body holding means by accelerating the tangential speed of said rotary body;

and further comprising a ball-like body separating means which is mounted to said rotary body for supplying to said body holding means one ball-like body at a time.

3. A ball-throwing apparatus as in claim 2, wherein said ball-like body separating means, said ball-like body holding means and said projecting means are integrated into a unitary assembly.

* * * * *